US005921442A

United States Patent [19]

Keller et al.

[11] Patent Number: 5,921,442

[45] Date of Patent: Jul. 13, 1999

[54] MANUALLY OPERATED SELF DEFENSE DEVICE

[76] Inventors: John F. Keller, 5915 Eddy Ct., Lake Worth, Fla. 33463; David A. Wilson, 314 Springdale Cir., Palm Spring, Fla. 33461

[21] Appl. No.: 08/916,030

[22] Filed: Aug. 21, 1997

Related U.S. Application Data

[51] Int. Cl.[6] ..... B67D 5/32

[52] U.S. Cl. ..... 222/153.13; 222/79; 222/340; 222/387

[58] Field of Search ..... 222/78, 79, 153.13, 222/340, 386, 387

[56] References Cited

U.S. PATENT DOCUMENTS 5,458,263 10/1995 Ciammitti et al. ..... 222/153.13
5,529,215 6/1996 Banks et al. ..... 222/153.13
5,709,320 1/1998 Jimenez ..... 222/340
5,779,100 7/1998 Johnson ..... 222/79
5,799,828 9/1998 Crawford ..... 222/79

*Primary Examiner*—Joseph A. Kaufman
*Attorney, Agent, or Firm*—Norman Friedland

[57] ABSTRACT

A manually operated self defense device comprising a manually operated pump driven propulsion chamber which can propel either a stream or spray at a potential attacker wherein the self defense device is characterized by the fact that no pre-pressurized gas or irritant canisters are used, and wherein the self defense device irritant or disabling storage container is not refillable by the user, and when used, the first pump action loads the propulsion chamber from a storage container, and thereafter, the propulsion chamber is always primed and ready for instant operation, and in as much as no pre-charged gas canisters are employed, there is no gas leakage, and reliability is greatly improved, resulting in a self protection device which is capable of providing multiple discharges without the loss of operating range, or effectiveness, and which contains an internal safety mechanism designed to prevent the attacker from turning the self defense device upon the user.

10 Claims, 4 Drawing Sheets

MANUALLY OPERATED SELF DEFENSE DEVICE

FIELD OF THE INVENTION

This invention relates to an improvement to an attack-repellant dispensing system designed to ward off potential attackers and particularly to the replacement of pre-pressurized canisters with a manual system for propulsion.

BACKGROUND OF THE INVENTION

Typical attack repellant devices are revealed in prior art U.S. Pat. Nos., 5,476,192, 5,439,301, and 5,503,304. These patents utilize pressurized cylinders of gas for the propulsive force. Gas may be carbon dioxide, Freon, compressed air, and the like.

This invention generally relates to a type of self-defense device for use by an intended victim of a robbery or other form of physical attack, wherein the intended victim protects himself by expelling a spray or stream of incapacitating or disabling material that is directed at the attacker, dissuading him from his mission. Violent crimes are most often committed against persons who are in isolated locations, but some perpetrators are sufficiently bold to attack victims on the street, in broad daylight. The majority of potential victims, include but are not limited to: joggers, shoppers, people who are approaching their vehicles in a parking lot, those leaving work at night, and those stopping to make a telephone call from a call box, those persons who are alone in an elevator, victims of car-napping, and the like. Experience has shown that the majority of such victims are women.

Fear of attack may cause people to believe themselves to be in jeopardy and a reliable protection device creates a sense of security. Personal audible alarms have proven to be ineffective, and they generally do not scare away an attacker, nor do they serve to summon help. The self defense device described herein is intended to fulfill the need for personal protection, without an audible alarm.

The class of safety devices in this category are typically spray devices which expel pepper or other incapacitating or disabling material. The irritating or disabling material, (hereinafter referred to as the "irritant") may be in either powder form or in solution. Powders have been used, but they can be misdirected by the prevailing wind. Irritants in solution are therefore the preferred methodology, however, powders will work in the instant invention. Powder operation will require separate valves distinct from those used with liquid materials, and accordingly, the same invention may be manufactured with either irritant, and including appropriate replacement of the nozzle orifice. The liquid irritant performs better than the powder, and is the preferred form of this invention. The liquid form of the irritant represents the best mode of the invention.

It is also known that some prior art systems have used a dye substance as well as a disabling substance to help the police identify the perpetrator. These devices have been used as a means of personal protection, and usually embody one or a plurality of gas canisters with the propellant gas under pressure. Gasses such as carbon dioxide and Freon have been used with varying degrees of success. The propellant gas is contained in a pressurized canister. In order to use the device, a valve must be depressed in order to release the gas contained in the canister, and thus initiate a discharge.

The exact amount of gas that is released under these conditions is never known, as the released gas is not metered. Other embodiments combine the irritant within the pressurized container along with the propellant, whereas still other embodiments use the pressurized gas solely as a propellant. Some systems mix and add the irritant before the exit nozzle or orifice is reached. The purpose of the of the compressed gas is to propel the disabling material toward the perpetrator. The irritant is designed to be non-fatal.

Disguise has been considered to be an important element in the design of prior inventions of this class. The prevalent belief was that the attacker should not be aware that his victim is armed, so that he is not directed toward removing the safety device from the victim prior to or during initiating his attack.

Some attackers, not knowing the true status of the carried object, will immediately attempt to grasp the carried object, no matter what it is. Inventions of earlier prior art have included disguises in their patents. Simulated telephone pagers, women's compacts, pocket calculators, transistor radios, and the like.

Although the instant invention may be included in simulated products, The invention described herein may also be included in a non-simulated, working, pager or a functional transistor radio, a fully functional camera with flash, and the like, thus providing both protection and actual usefulness. This invention also recognizes that whereas disguised devices of this sort are prevalent, such disguises are not necessary, and accordingly, the instant invention can be produced for protection only, without any fancy packaging. It has been found that these personal protection devices, even without any disguise, can provide the same sense of security as the disguised devices.

Often, the process of disguise, and the resulting packaging restrictions result in extra cost to the product, and forces compromises in the device utility and design. In many cases, the perpertrator is aware that the intended victim is carrying a form of personal protection, and rather than risk exposure thereto, he will seek a different victim. In this invention, the non-disguised personal safety device represents the best mode.

PRIOR ART

U.S. Pat. No. 5,476,192, granted to Julinot, on Dec. 19, 1995 shows a "Self-defense Device" disguised as a calculator, tape recorder, sport radio, a camera, dumbbell and an umbrella. Said devices contain a pre-pressurized canister of material to be sprayed, or a plurality of canisters where one canister contains a pressurized gas propellant, and the other canister contains an irritant powder or solution of irritant. A plurality of gas canisters for propulsion may also be employed.

These devices of the prior art also contain an audible alarm. It is understood by those skilled in the art that disguises are not limited to those shown in the prior art patents. Prior art U.S. Pat. No. 5,429,301, granted to H. T. Franks on Jul. 4, 1995 "Personal Defense Device and Method" reveals a device which is disguised as a telephone pager or beeper. Said device contains a plurality of pre-charged and pressurized canisters to expel gas and the irritant or disabling agent. In U.S. Pat. No. 5,429,301, an audio alarm is also provided.

Prior art U.S. Pat. No. 5,503,304 "Protective Security System" granted to John F. Keller on Apr. 2, 1996 is also a reference. Similar to the previous patents, U.S. Pat. No. 5,503,304 contains a pre-charged canister of pressurized propellant gas and a canister of disabling agent, these combined during the discharge process.

In the Keller U.S. Pat. No. 5,503,304, the protective device is located in a wristband. There is little attempt to disguise the security system as a commonly used device. In one embodiment, an attached wrist band is worn which activates a disabling switch when pulled, thus preventing the assailant from turning the safety device on the intended victim. A push button on the wrist band activates the system by releasing the pressurized gas in the enclosed canister into a second canister containing the irritant or dye substance, the mixture exiting through the discharge nozzle.

There are several major deficiencies in the prior art in which the spray devices use a pre-pressurized canister of gas as a propellant. These include: loss of propellant after the initial use, and a resulting low level of reliability. It is known that after long periods of disuse, the pre-pressurized canisters lose pressure and may be unusable when needed. The user never knows when the system has leaked gas pressure and will thus offer little or no protection. Furthermore, the system of the prior art can usually be actuated by a child. A child can release the gas from the charged cylinder by depressing the activating button. Direct close involvement of the disabling irritant, under pressure, coming in contact with the victim's eyes may result in permanent injury. Attempts to increase the required valve pressure in order to protect the system from being used by a child have proven to be ineffective. The increase in activation force makes the device difficult to use.

BRIEF SUMMARY OF THE INVENTION

It is an object of this invention to overcome the deficiencies which are inherent in the prior art, specifically, wherein a pre-pressurized canister, or a plurality of pressurized canisters, are used either as a sole propellant or mixed with the disabling agent, as described herein. This invention eliminates the pre-pressurized canisters and includes a manual system in place ofthe pre-charged canisters, the protection device is made more reliable without the loss of effectiveness. Effective ranges of liquid stream of 15 feet have been achieved with formed as single system.

It is another object of this invention to provide a manually operated self defense device which is capable of providing multiple discharges at an attacker with no loss of performance. The design will allow a minimum of five complete discharges.

In the embodiment of the instant invention, a manually operated plunger and attached piston is operated by a slidable trigger mechanism or a lever. Said piston is movably positioned within a propulsion chamber having a rear cavity and a forward cavity. Said forward cavity and said rear cavity are separated by a slidably movable piston. The forward cavity is located forward of the movable piston and the rear cavity is located at the rear of the movable piston. During operation, the forward cavity will be filled with an irritating or disabling fluid. Moving the piston forward will cause the irritant substance to be expelled through the exit nozzle toward the attacker.

The Piston forward cavity of the propulsion chamber is connected to a storage container for storing the irritating material or disabling fluid or powder. The storage container is connected to the forward cavity through a one way valve. As the piston moves rearward under the force provided by a return spring, the piston rearward motion reduces the air pressure in the forward chamber, causing the irritant substance to flow into the forward chamber. An air inlet in the rear chamber prevents the rear chamber from forming a vacuum when the piston is moving forward. When the trigger is squeezed the piston is driven forward expelling the irritant through the exit valve and through a nozzle, at the attacker. Releasing the pressure on the trigger causes the piston to be returned to its rearmost position, thus, repeating the charge cycle. The storage container is designed so that replacement by the user is not feasible. This prevents the user from replacing the irritating or disabling agent with another substance which is more dangerous, as for example, an acid. The present invention is capable of producing multiple discharges. It is expected that the safety device will be discarded when emptied. The system can be recharged at the factory at a nominal cost. An OSHA warning label will be included on the personal safety device package.

BRIEF DESCRIPTION OF THE DRAWINGS

FIG. 4A is a plan view, FIG. 4B is a side view of the same elements.

DETAILED DESCRIPTION OF THE PREFERRED EMBODIMENT

Figure 1:
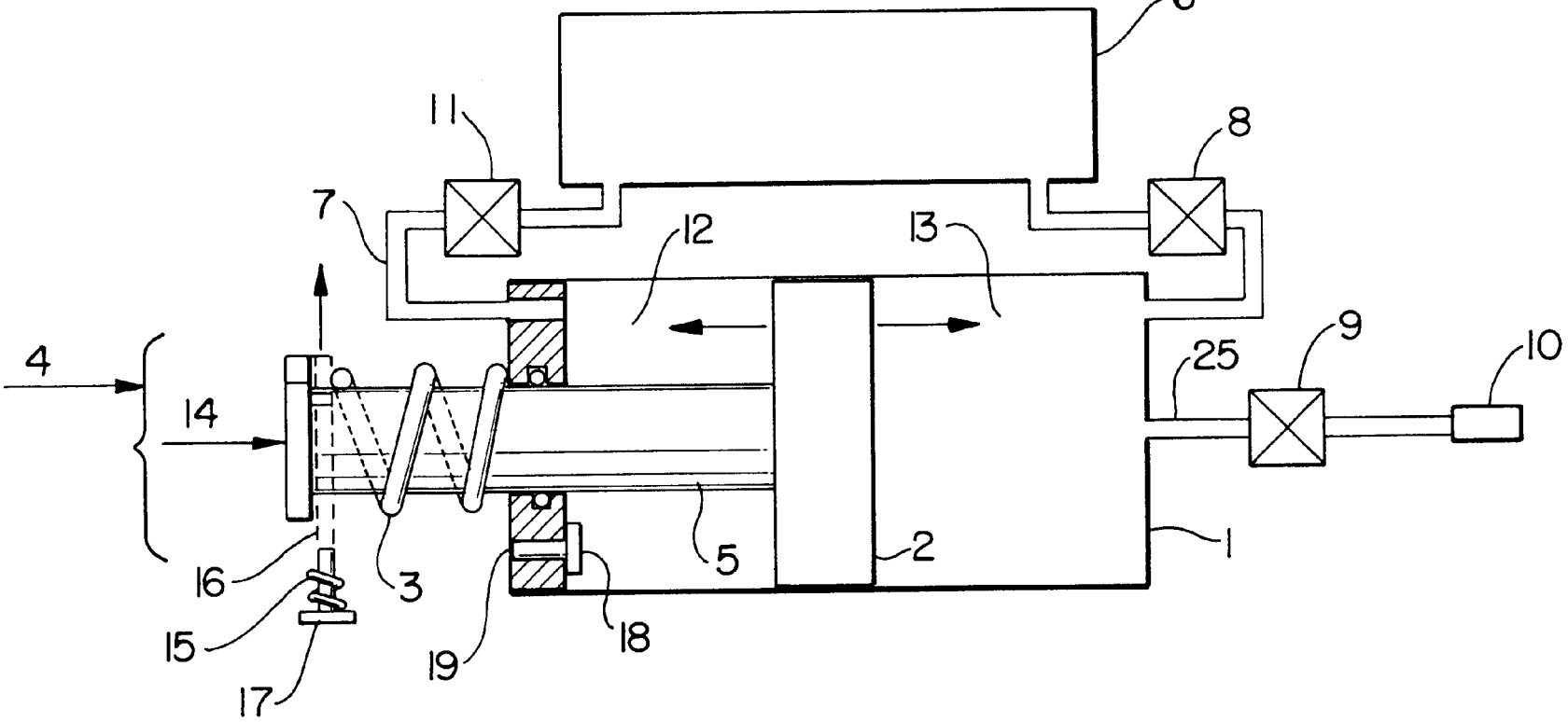
FIG. 1 is a schematic diagram illustrating the present invention.

As will be apparent from the description to follow in which the preferred embodiment of the instant invention is revealed, pre-pressurized vessels of gas and canisters of disabling material are totally eliminated. There is no leakage of propellant, and the system can be used at any time by manually pumping an actuator. The actuator can be a trigger, or a lever. In the preferred embodiment of this invention, the manually operated pump mechanism initiates the spray or stream of irritant or disabling substance toward the attacker. The basic diagram of the manually operated self defense system is shown in FIG. 1. Notably absent are pre-charged gas canisters of any kind. The system contains an irritant storage container, (6) which has been pre-loaded at the factory with an irritant or disabling solution or an irritant or disabling powder. The physical system consists of a propulsion chamber (1) into which a slidably movable plunger (5) having a forward end and a rearward end, said plunger having a piston (2) affixed to the forward end.

The presence of the piston within the propulsion chamber creates a forward piston cavity (13) and a rearward piston cavity (12). Application of a force (14) supplied by a manual slidably movable trigger (4) initiates the motion of said plunger (5) forward, compressing the irritant within the forward piston cavity, (13) causing the irritant to pass through the exit valve (9), through a section of tubing (25) and out of the nozzle (10).

The first time that the plunger (5) is depressed, air in the forward cavity (13) of the propulsion chamber (1) is driven out of by the forward motion of the piston (2). When the trigger (4) is released, return spring (3) draws the piston rearward. When the piston is thus drawn rearward, the pressure in the forward piston cavity (13) of the propulsion chamber (1) is reduced.

In this manner the rearward motion of the piston causes the irritant substance to flow through the inlet valve (8) and into the forward chamber. (13) Thus, the forward cavity of the propulsion chamber fills and the safety device is ready to be used.

When the squeezable slide trigger (4) is next depressed, the plunger (5) moves forward, causing the piston (2) to move forward, thus pressurizing the irritant in the forward chamber, driving the fluid or powder in the front cavity of the propulsion chamber through the exit valve (9) and out through the nozzle (10). The exit valve (9) is necessary to prevent air from entering the forward piston cavity when the piston is retracted. The mechanical design also provides for a lever and cam (4) to be used as the force generator or trigger, thereby reducing the force which is required to operate the device.

Figure 5A:
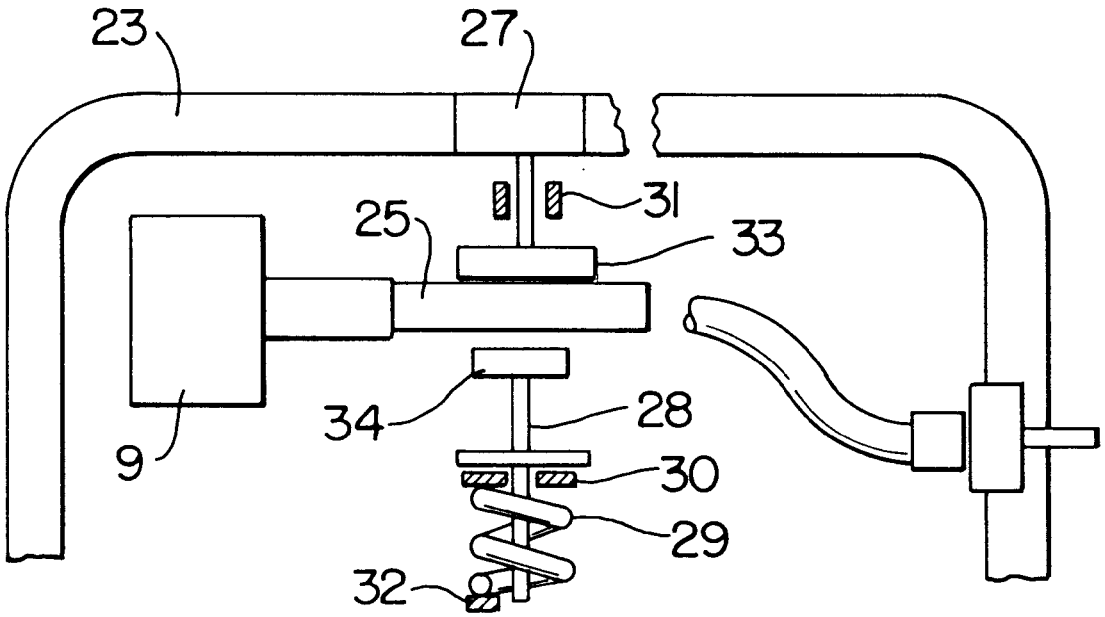
FIGS. 5A and 5B are a detail of an alternate locking mechanism where the locking function is a squeezing of the tygon tubing, which prevents fluid flow.
Figure 5B:
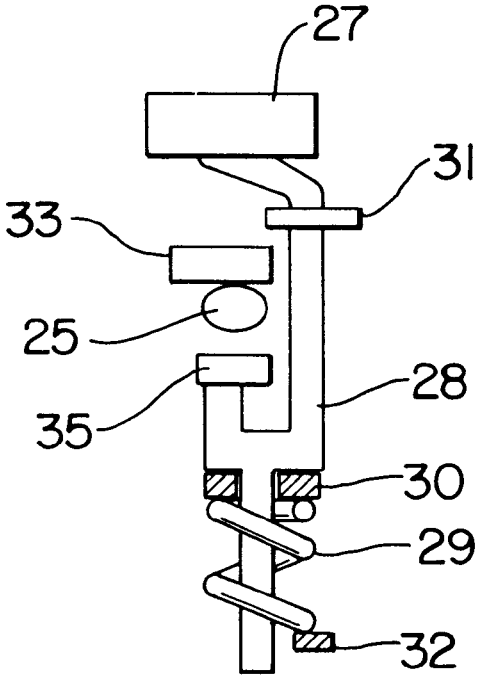

A locking device (15) prevents the system from being deployed when the self defense device is removed from the user's hand. A return spring (16) causes the plunger (5) to be locked when the safety button (17) is released. A guide ring (24) stabilizes the locking device. An alternate safety locking mechanism which is shown in FIGS. 5A and 5B includes a means for clamping a tygon tubing when the manually operated self defense device is at rest. Said clamping means shown in FIGS. 5A and 5B, comprising an anvil (33), a movable strut (28), a pressure pad (35), a return spring (32), and spring supports (30) and (32) and a strut guide (31). When at rest, the strut (28) is moved upwards, by the action of spring (29) causing the flexible tygon tubing (25) to be compressed, thus inhibiting the flow of irritant to the nozzle (10). Pressing a secreted button (27) causes the strut (28) to move in a direction which increases the relative distance between the anvil (33) and the pressure pad (35). This operation opens the tygon tubing (25) and the irritating fluid is allowed to flow outward to the nozzle (10). When the fluid flow safety locking device is used. The plunger locking safety device is not used.

FIG. 1 also shows a novelty of the instant invention as a solid line (7) between the rear of the propulsion chamber (1) and the storage container (6). A one way valve (11) provides air from the rear cavity of the propulsion chamber into the storage means (6), when the piston retracts, said valve (11) prevents the air from escaping back into the piston cavity as the piston moves forward. In this manner the rearward motion of the piston (2) supplies air to the storage means, slightly pressurizing the storage means (6) while at the same time the irritating agent is simultaneously delivered to the forward cavity of the propulsion chamber (13) The rear cavity of the propulsion chamber (1) is further fitted with an air inlet (19), a one way valve (18) which allows air to flow into the rear piston cavity (12) as the piston moves forward.

The air inlet (19) in communication with an air valve (18) in the rear of propulsion chamber (1) allows the rear piston cavity to be filled with air as the piston moves forward. As the piston is retracted by the return spring (3). The air which is trapped in the rear piston cavity (12) is directed through a one way valve (11) into the storage means (6). Pressurization of the storage means helps the main or forward cavity of the propulsion chamber (13) fill more readily as the piston retracts. This feature enhances operation when irritant powders are used, and makes operation with liquid rritants more reliable.

Figure 4A:
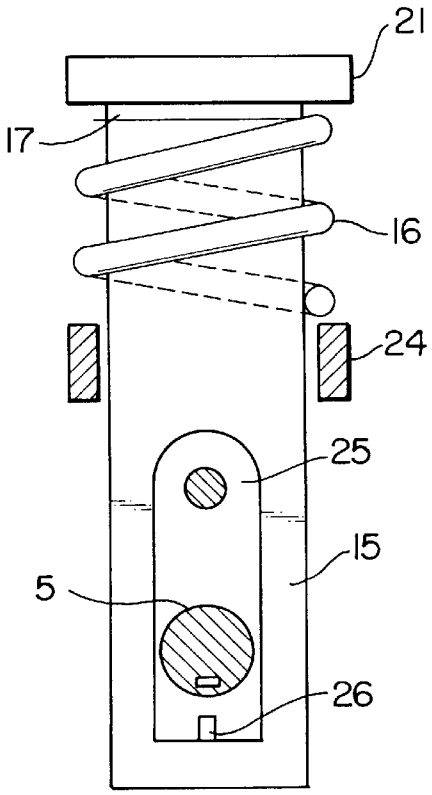
FIGS. 4A and 4B are a detail of the safety plunger locking device described herein.
Figure 4B:
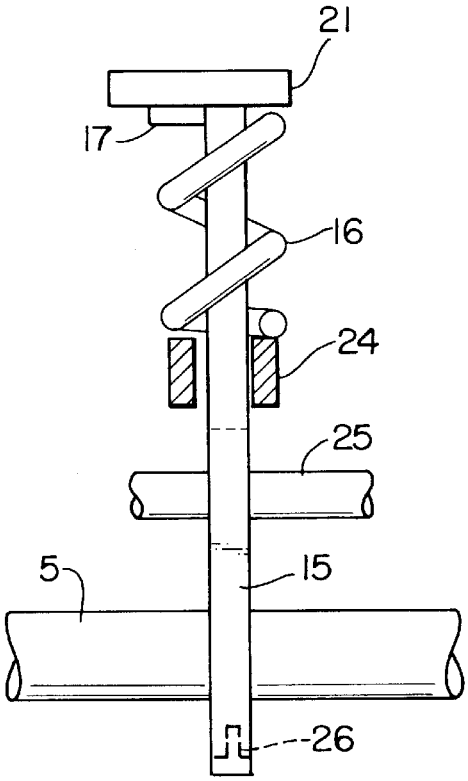

A seal (22) interposed between the rear end of the piston cavity and the slidable plunger (5) prevents air from escaping from the rear piston cavity when the piston moves rearward, In the instant invention, a safety switch, comprising a secreted pressure operated release button (21) on the housing body (23) will operate the safety system by releasing the locking tongue (15), disengaging the tongue from the plunger (5) allowing the plunger to move forward when the safety switch is depressed. In the event the perpetrator attempts to wrench the self defense device away from the user, the pressure on the locking mechanism button (21) is released, spring (16) returns the locking tongue (15) to the locking position wherein the tongue slides into a derpression in the plunger (5) thereby disabling the spray function by immediately locking the trigger mechanism (5). A guide ring (24) stabilizes the locking system. FIG. 4 shows a detail of this safety feature. This feature prevents the attacker from turning the protection device on the intended victim. The hidden mechanism will also prevent a child from using the protection device and thereby hurting himself.

The manually operated self defense device outer housing (23) is formed as a sealed enclosure of easily molded material. Plastics such as PVC, Nylon, Celcon, and Delrin have been used, with Nylon being the preferred material. Ultrasonic sealing, thermal sealing, or chemical bonding may be used to join the housing member halves together.

The sealed outer housing makes it impossible for the user to tamper with or replace the storage container. The sealed outer housing also contains a tiny air inlet opening for entry of outside air. An OSHA label (20) provides cautionary and operating information for the user.

Figure 2:
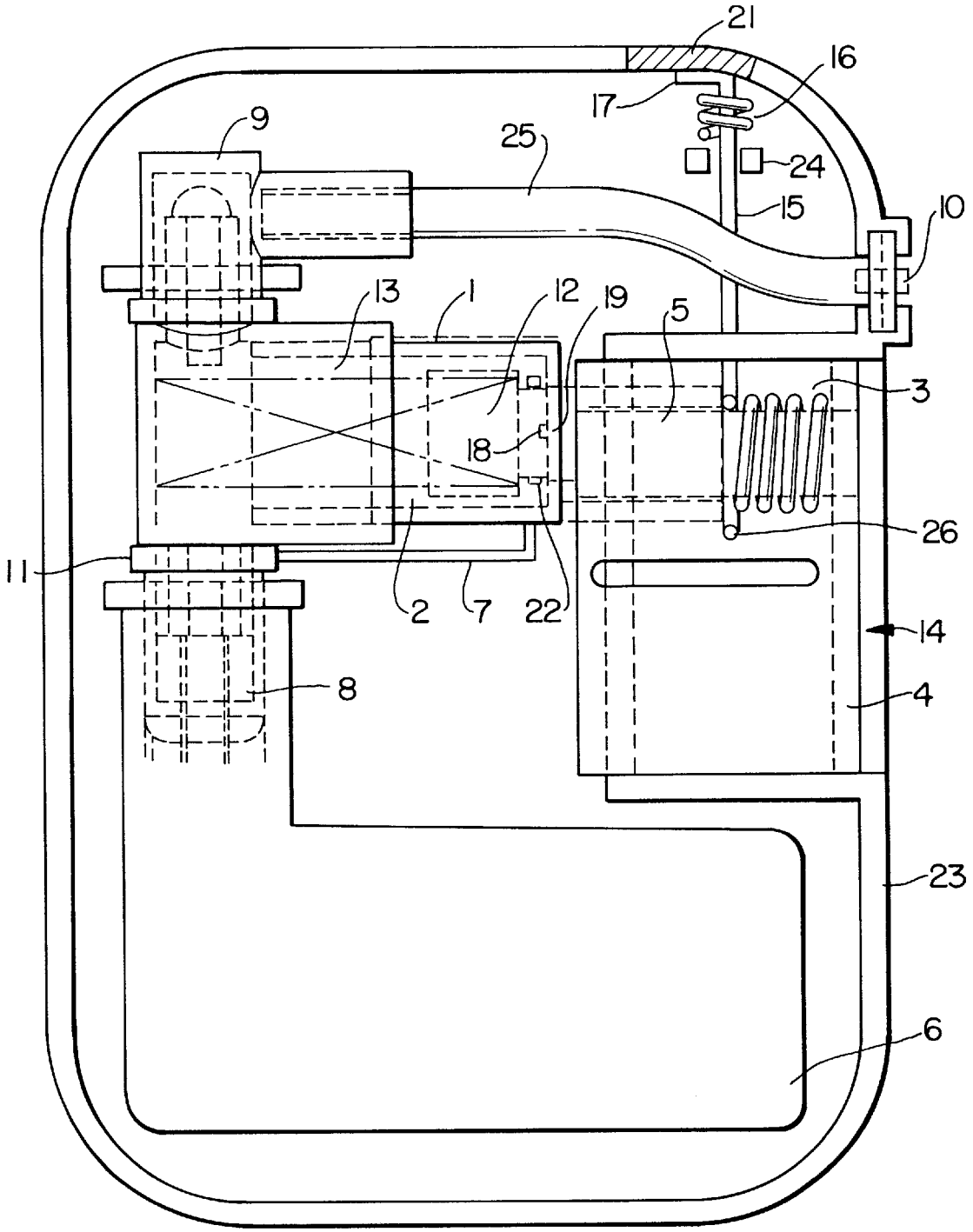
FIG. 2 is a diagram of the commercially produced product which employs the instant invention.

FIG. 2 reveals a commercially produced version of the instant invention. The element numbers are the same as those shown in the basic diagram, FIG. 1.

Figure 3:
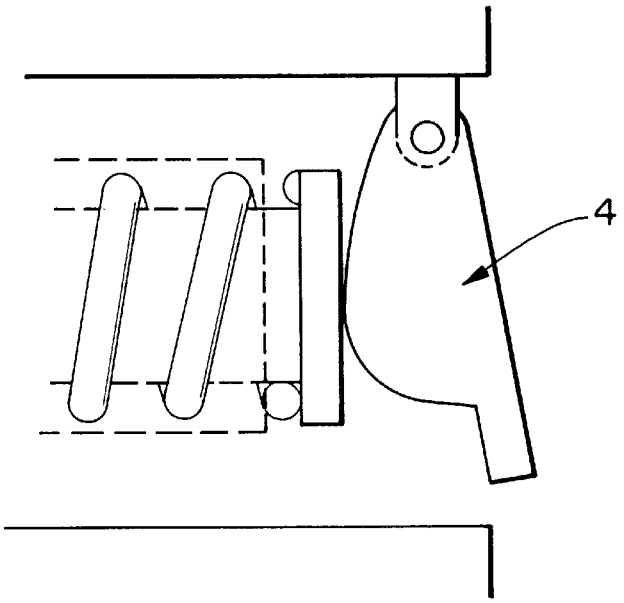
FIG. 3 is a modified trigger mechanism, wherein the slidably movable trigger is replaced by a cam-lever device.

FIG. 3 shows a detail of the manually operated self defense device wherein the manually operated slide trigger is replaced by a cam-lever type of trigger. The advantage of the lever is that it requires less effort to actuate the device than does the slide trigger previously described.

FIG. 4 shows the trigger safety mechanism. In the embodiment of the instant invention, a manually operated plunger, operated by a sliding trigger mechanism or a lever is movably positioned in a propulsion chamber, said movable plunger operating a movable piston which is attached to the forward end of said plunger. The rear end of the plunger projects outward from the propulsion chamber and connects with the slidably movable trigger or lever which in turn is operated by hand. Said propulsion chamber is comprised of a rear cavity, which is located behind the piston, and a forward cavity which is located in front of the piston. When the plunger is initially moved forward in the direction of the exit valve, the movable piston in the propulsion chamber moves forward in the front cavity of the propulsion chamber which contains said irritant or disabling fluid, thus forcing said fluid through an exit valve, and out through the nozzle. When aimed by the user, the irritant is forcibly directed at the attacker. The chamber is connected to a non-replaceable storage means for storing the irritating material or disabling fluid. Thereafter, return operation of said pump piston by the return spring will replenish the irritant in the pump chamber, preparing the system for another operating cycle. The initial stroke defined above which primes the unit may be performed at the factory during the test phase so that the system arrives at the user ready to use. Alternatively, the user may initiate the priming cycle when the unit is purchased. This keeps the active ingredients safely stored in the storage container until needed.

In the instant invention embodiment, a safety switch, comprising a secreted pressure sensor on the housing body will enable the system by releasing the trigger mechanism or the flow means when depressed. In the event the perpetrator attempts to wrench the device away from the user, the pressure on the sensor is released, thus disabling the spray function by immediately locking the trigger mechanism. This feature prevents the attacker from turning the protection device on the intended victim. The hidden mechanism will also prevent a child from using the protection device and thereby hurting himself. An OSHA label provides cautionary and operating information for the user.

We claim:

1. A manually operated self defense system which does not use pre-charged gas cylinders comprising: a housing to be carried in the hand of a user, said housing supporting an irritant inlet valve, an irritant exit valve, a nozzle, an air inlet port, an air inlet valve, a storage means within said housing for carrying a supply of irritant, a flexible tubing for fluidly connecting said irritant to a propellant chamber communicating said irritant through said inlet valve, said propellant chamber having a forward cavity, a rear cavity, wherein front and rear cavities are separated by a slidably movable piston, said inlet valve connected between said storage means and said propellant chamber for leading said irritant in the direction from said storage means to said forward cavity, said piston movable and operable within said propellant chamber for pressurizing said forward cavity when said piston moves in a forward direction, wherein the action of said movable plunger, movable manually by depressing a trigger mechanism for moving said piston in the forward direction, said trigger mechanism being a slidable trigger, said motion of said piston forcing said irritant, to load said irritant through a one way valve outwardly through said nozzle toward the attacker, said rear cavity of said propellant chamber, having the one way air inlet valve for providing air into said rear cavity of said chamber, and a one way exit valve, a flexible tubing for fluidly connecting said exit valve and said storage means, a slidably movable plunger for moving said piston, a return spring for returning said plunger to a rearward position when released, a seal for said plunger preventing air within said rear cavity from escaping, a spring biased locking means and a guide ring for unlocking said plunger when depressed by the user, whereby the assailant is unable to use said system without depressing said locking means, and a safety mechanism adapted to inhibit said irritant from flowing to said nozzle.

2. The manually operated self defense device of claim 1 wherein the operating trigger is a cam and lever.

3. The manually operated self defense device of claim 1 capable of multiple discharges without the loss of effectiveness or range.

4. The manually operated self defense device of claim 1 wherein a secreted safety mechanism prevents the attacker from turning the self protection device upon the victim.

5. The manually operated self defense device of claim 4 wherein the safety mechanism locks the pump plunger.

6. The manually operated self defense device of claim 4 wherein the safety mechanism restricts the flow of the irritant.

7. The manually operated self defense device of claim 1 wherein the storage means is continuously pressurized as the result of operation of the propulsion piston.

8. The manually operated self defense device of claim 1 wherein the storage means is not refillable by the user.

9. The manually operated self defense device of claim 1 wherein air is admitted into the rear piston cavity through a one way valve which closes as the piston is retracted.

10. The manually operated self defense device of claim 1 wherein the safety switch means inhibits the flow of irritating substance from reaching the exit nozzle.

* * * * *